US006805335B2

(12) United States Patent
Williams

(10) Patent No.: US 6,805,335 B2
(45) Date of Patent: Oct. 19, 2004

(54) RAIL MOUNTING SYSTEMS AND METHODS

(76) Inventor: Robert M. Williams, 7034 E. Court St., Davison, MI (US) 48423

( * ) Notice: Subject to any disclaimer, the term of this patent is extended or adjusted under 35 U.S.C. 154(b) by 0 days.

(21) Appl. No.: 10/214,933

(22) Filed: Aug. 8, 2002

(65) Prior Publication Data

US 2004/0026680 A1 Feb. 12, 2004

(51) Int. Cl.[7] ..... E04H 17/14
(52) U.S. Cl. ..... 256/67; 256/65.06
(58) Field of Search ..... 256/60.05, 66, 256/65.06, 68, 65.02, 69, 65.03, 65.04, 65.01, 65.1, 67; 52/720.2

(56) References Cited

U.S. PATENT DOCUMENTS 1,258,460 A * 3/1918 Rees ..... 256/66
5,141,207 A * 8/1992 Meglino et al. ..... 256/33
5,938,184 A * 8/1999 DeSouza ..... 256/19
6,017,019 A * 1/2000 Erwin ..... 256/65.05
6,308,937 B1 * 10/2001 Pettit ..... 256/65.05
6,311,955 B1 * 11/2001 McGarry et al. ..... 256/24
6,471,192 B1 * 10/2002 Erwin ..... 256/65.05
6,543,751 B1 * 4/2003 Spruill ..... 256/65.04
6,601,831 B2 * 8/2003 Erwin ..... 256/65.05
2002/0023406 A1 * 2/2002 Pettit et al. ..... 52/720.2
2003/0164486 A1 * 9/2003 West ..... 256/65.1

FOREIGN PATENT DOCUMENTS

CA 2322610 A1 * 4/2002 ..... E04H/17/14

* cited by examiner

*Primary Examiner*—James R. Brittain
(74) *Attorney, Agent, or Firm*—Myers Bigel Sibley & Sajovec, P.A.

(57) ABSTRACT

A rail system for mounting on a vertical support includes a rail assembly having an end portion and including a reinforcement rail and a polymeric sleeve at least partly surrounding the reinforcement rail. A metal bracket defining a rail cavity adapted to receive the attachment end and adapted to secure the rail assembly to the vertical support.

31 Claims, 11 Drawing Sheets

RAIL MOUNTING SYSTEMS AND METHODS

FIELD OF THE INVENTION

The present invention relates to support or guard rails and, more particularly, to systems for mounting support or guard rails on posts and the like.

BACKGROUND OF THE INVENTION

Support rails and guard rails are commonly employed to surround areas such as the raised platforms of decks and stairways. For outdoor decks and the like, it is often desirable to use a rail formed of a polymer (e.g., vinyl) or having a polymeric cladding because such rails may be more attractive than wooden rails, for example. Such rails are typically more durable and easier to maintain than wooden rails as well.

SUMMARY OF THE INVENTION

According to embodiments of the present invention, a rail system for mounting on a vertical support includes a rail assembly having an end portion and including a reinforcement rail and a polymeric sleeve at least partly surrounding the reinforcement rail. The rail system further includes a metal bracket defining a rail cavity adapted to receive the attachment end. The bracket is adapted to secure the rail assembly to the vertical support.

According to further embodiments of the present invention, a rail mounting system for mounting a rail on a vertical support, the rail including an end portion, includes a metal bracket including a rear wall and a side wall. The bracket includes a rail cavity adapted to receive the end portion and a support fastener opening adapted to receive a fastener to secure the bracket to the vertical support. A polymeric cover member is adapted to at least partly surround the bracket and a portion of the rail.

According to further embodiments of the present invention, a rail system for mounting on a vertical support includes a rail assembly having an end portion. The rail assembly includes a reinforcement rail and a polymeric sleeve at least partly surrounding the reinforcement rail. A rigid bracket is adapted to secure the rail assembly to the vertical support and includes a rear wall and a second wall extending forwardly from the rear wall. The bracket defines a rail cavity adapted to receive the attachment end. A support fastener opening in the rear wall is adapted to receive a fastener to secure the bracket to the vertical support. A rail fastener opening in the second wall is adapted to receive a fastener to secure the attachment end to the bracket.

According to further embodiments of the present invention, a rail system for mounting on a vertical support includes a rail assembly having an end portion. The rail assembly includes a reinforcement rail and a polymeric sleeve at least partly surrounding the reinforcement rail. The reinforcement rail includes an exposed portion extending beyond the polymeric sleeve. A rigid bracket defining a rail cavity is adapted to receive the attachment end and is adapted to secure the rail assembly to the vertical support. The bracket is adapted to bindingly engage the exposed portion such that the polymeric sleeve is not bound by the bracket, whereby the polymeric sleeve is able to expand and contract without interference with the bracket.

According to further embodiments of the present invention, a bracket for mounting a rail on a vertical support is provided. The bracket includes a slot adapted to receive and temporarily retain a tape measure hook.

According to further embodiments of the present invention, an angled rail mount system for mounting a rail on a vertical support includes a bracket defining a rail cavity adapted to receive and hold an end portion of the rail. An angle adapter is provided including a front face adapted to engage the bracket and a rear face adapted to engage the vertical support. The rear wall forms an angle of less than 180 degrees with the front face. The angle adapter includes a locator projection extending from the front face. The bracket defines a locator hole therein adapted to receive the locator projection.

According to method embodiments of the present invention, a method for mounting a rail assembly on a vertical support is provided. The rail assembly includes a reinforcement rail and a polymeric sleeve at least partly surrounding the reinforcement rail. A bracket is mounted on the vertical support. An end portion of the rail assembly is inserted into the bracket. The bracket is secured to the end portion of the rail assembly such that an exposed portion of the reinforcement rail extending beyond the polymeric sleeve is bound by the bracket and the polymeric sleeve is not bound by the bracket, whereby the polymeric sleeve is able to expand and contract without interference with the bracket.

According to further method embodiments of the present invention, a method for mounting a rail on first and second spaced apart vertical supports is provided. A first bracket is mounted on the first vertical support. A second bracket is mounted on the second vertical support. A hook of a tape measure is inserted in a first slot in the first bracket. A distance is measured from the first slot to a second slot in the second bracket. The length of the rail is trimmed or selected based on the distance measured.

Objects of the present invention will be appreciated by those of ordinary skill in the art from a reading of the figures and the detailed description of the preferred embodiments which follow, such description being merely illustrative of the present invention.

DETAILED DESCRIPTION OF THE PREFERRED EMBODIMENTS

Figure 1:
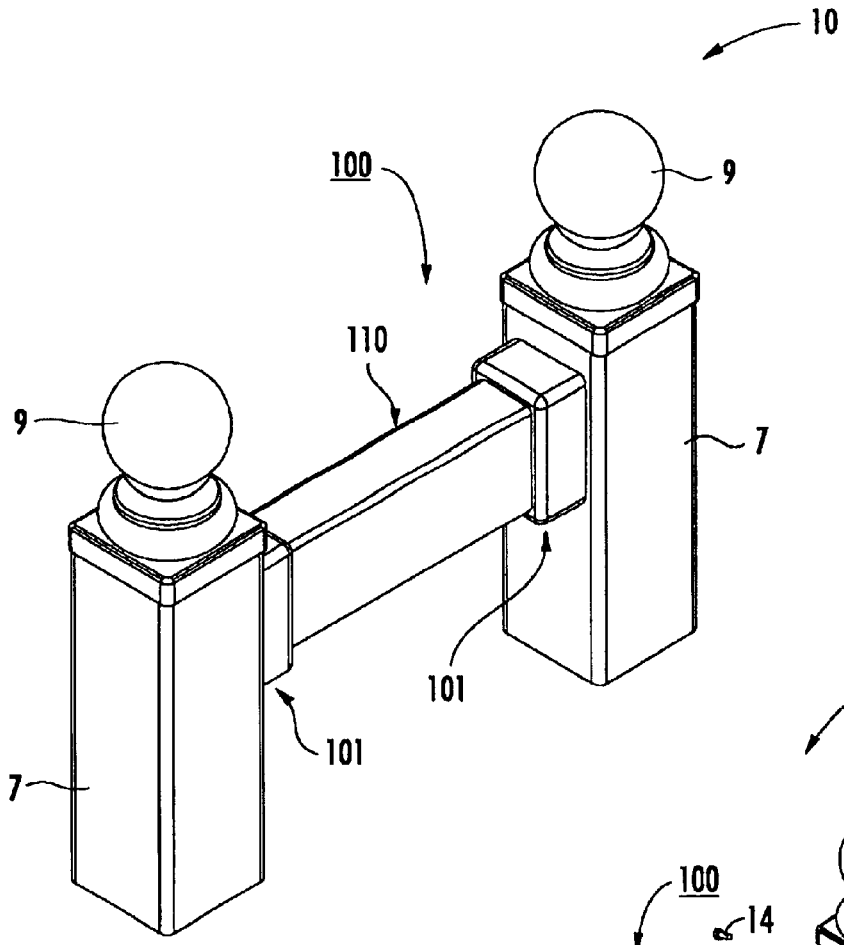
FIG. 1 is a perspective view of a rail/support system according to embodiments of the present invention.

The present invention now will be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. In the drawings, the relative sizes of regions may be exaggerated for clarity. It will be understood that when an element such as a layer, region or substrate is referred to as being "on" another element, it can be directly on the other element or intervening elements may also be present. In contrast, when an element is referred to as being "directly on" another element, there are no intervening elements present.

With reference to FIGS. 1–4 and 20, a rail system 100 according to embodiments of the present invention is shown therein. The rail system 100 includes a rail mounting system 101 according to embodiments of the invention. The rail system 100 may be used in conjunction with a pair of posts 7 to form a rail/support system 10. The posts 7 may be provided with decorative finials 9.

The rail system 100 includes a rail assembly 110 and the rail mounting system 101. Each rail mounting system 101 includes a rigid bracket 140A or 140B, a cover 170A or 170B, a pair of post fasteners 12 and a pair of rail fasteners 14.

Figure 2:
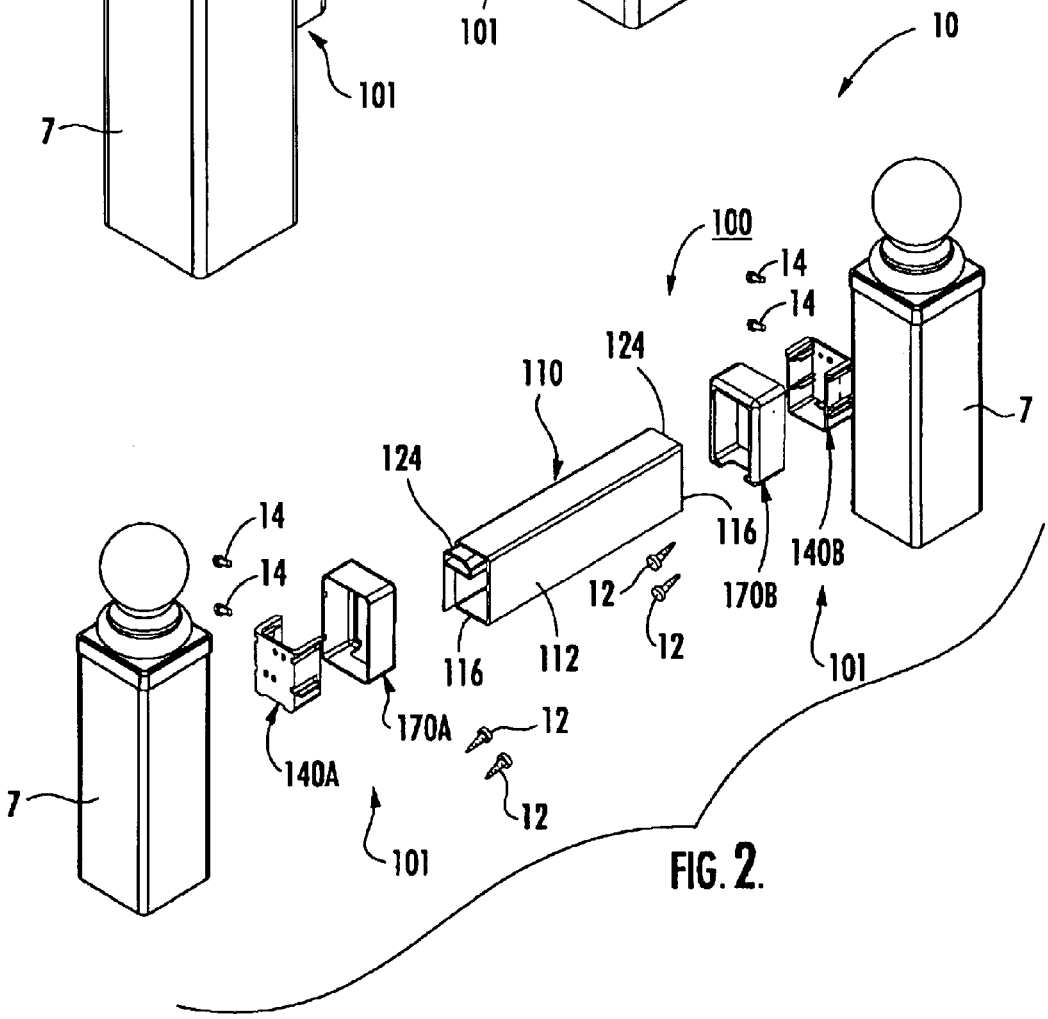
FIG. 2 is an exploded, perspective view of the rail/support system of FIG. 1.
Figure 3:
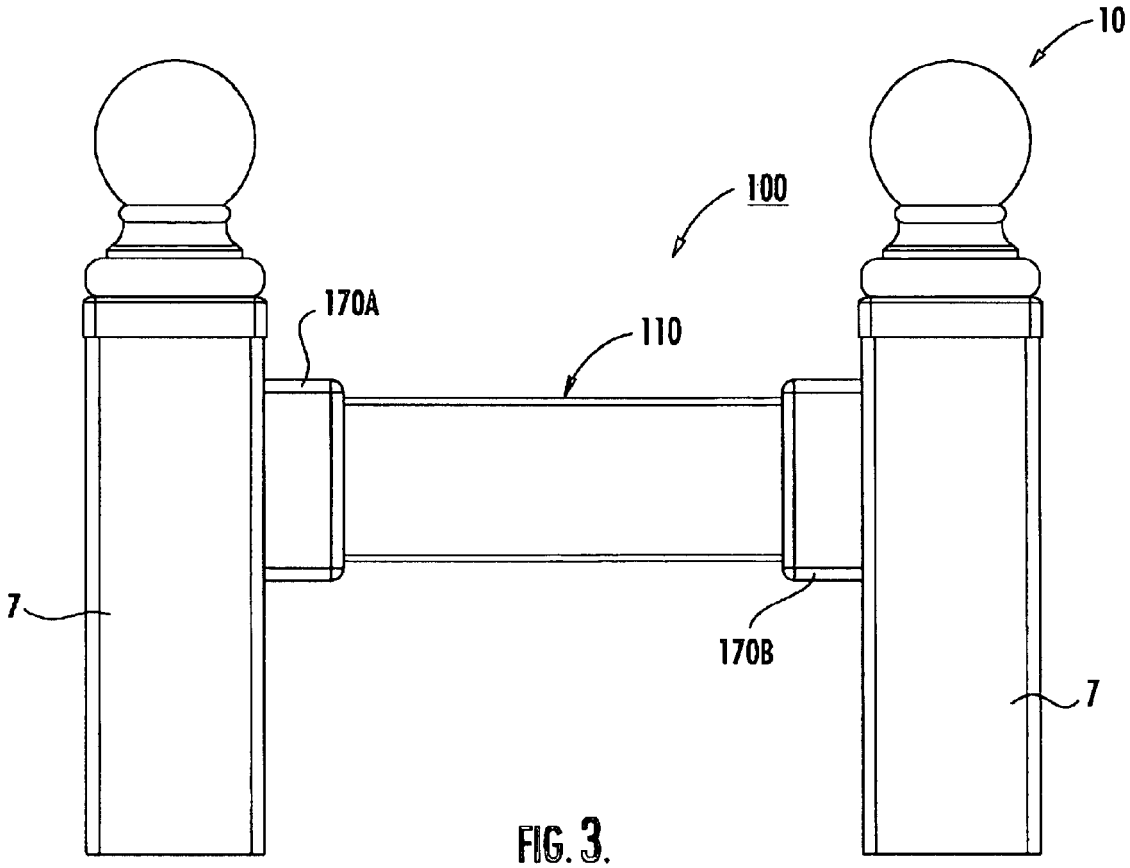
FIG. 3 is a side view of the rail/support system of FIG. 1.
Figure 6:
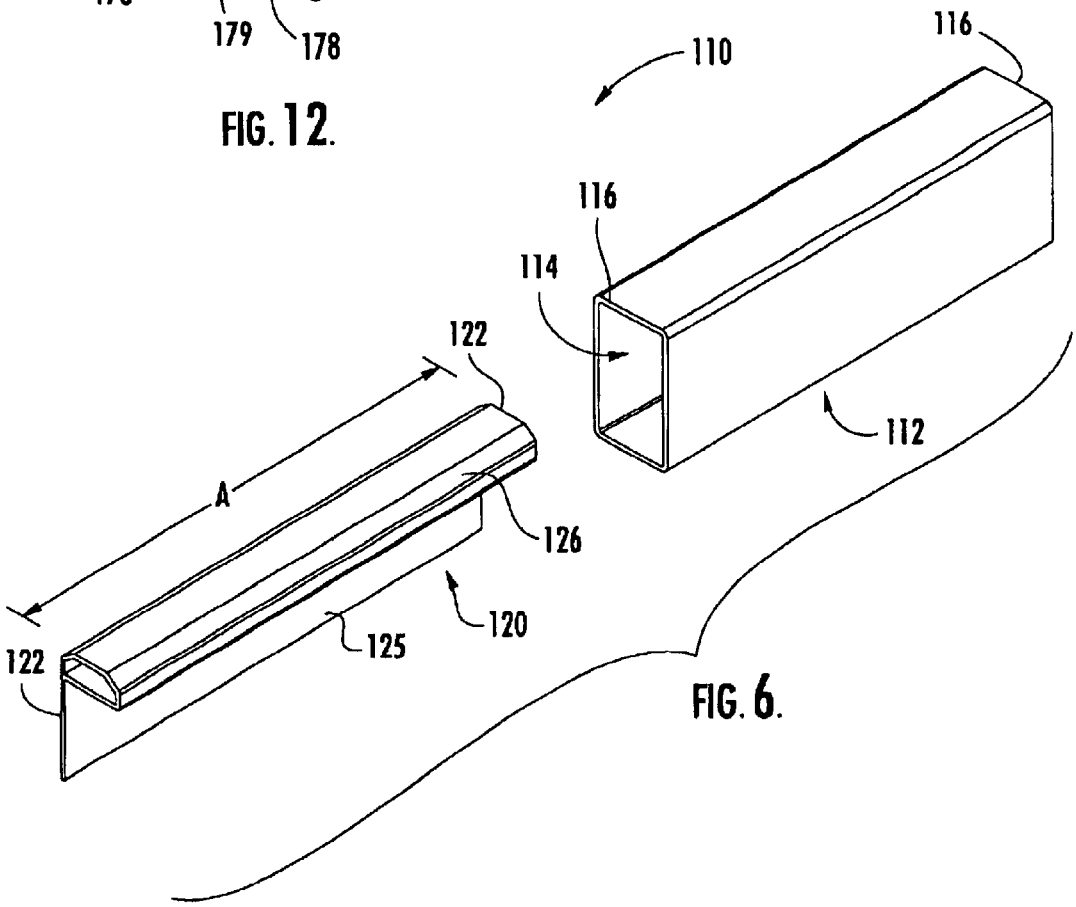
FIG. 6 is an exploded, perspective view of a rail assembly forming a part of the rail/support system of FIG. 1.
Figure 7:
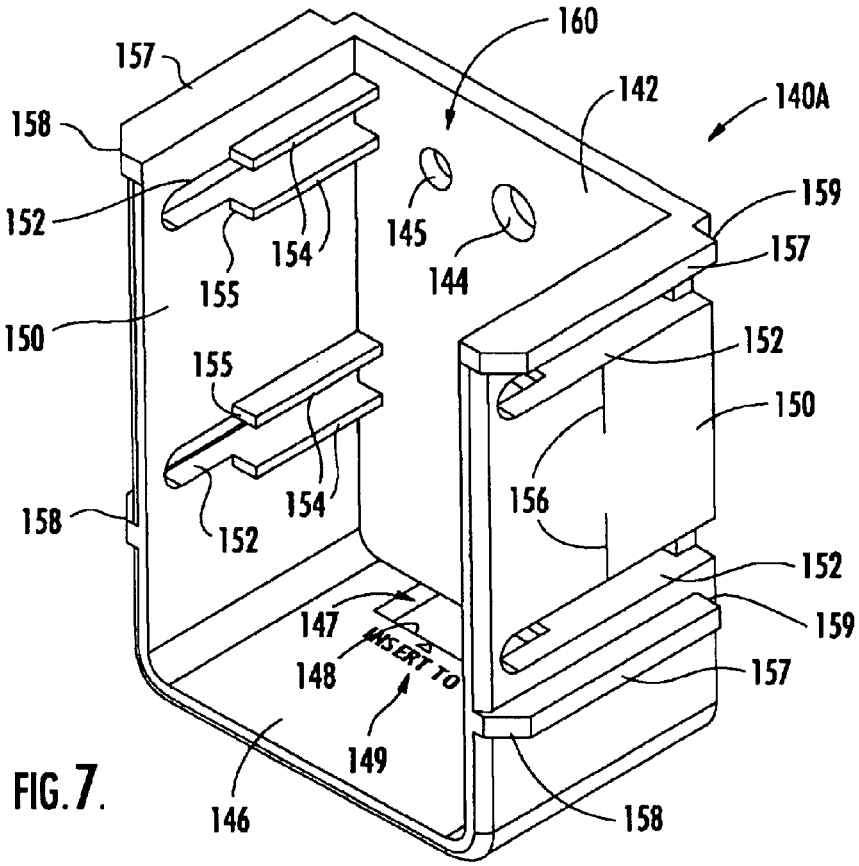
FIG. 7 is a perspective view of a bracket forming a part of the rail/support system of FIG. 1.
Figure 8:
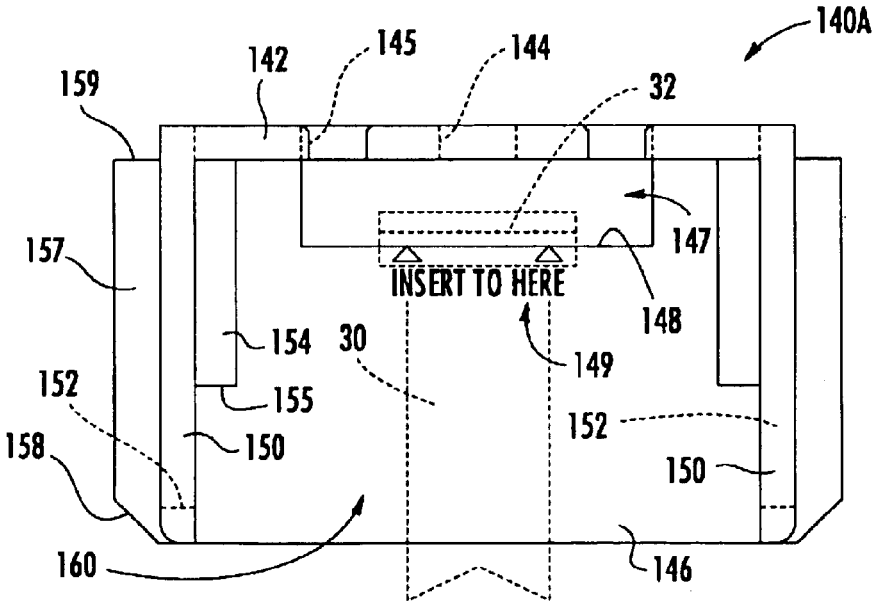
FIG. 8 is a top view of the bracket of FIG. 7.
Figure 9:
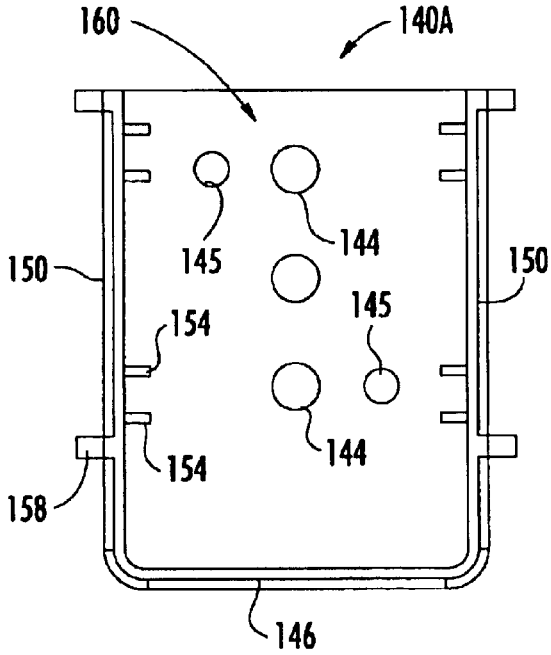
FIG. 9 is a front view of the bracket of FIG. 7.
Figure 10:
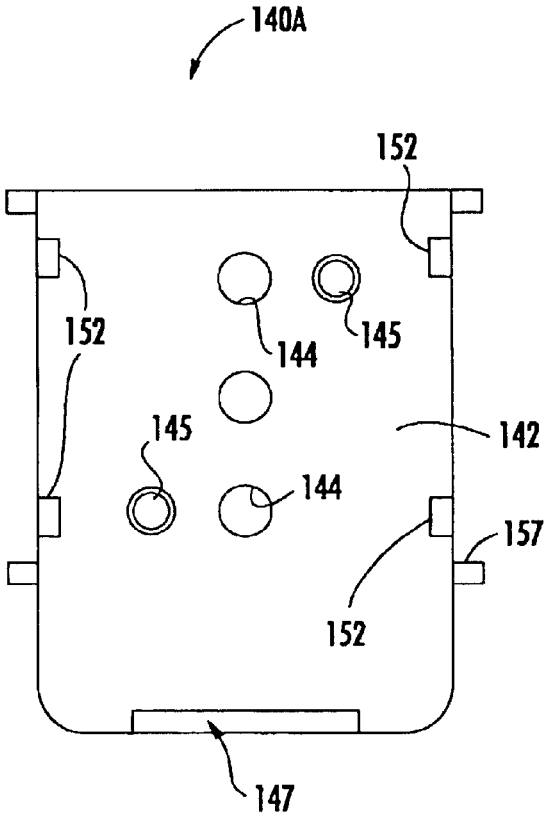
FIG. 10 is a rear view of the bracket of FIG. 7.
Figure 11:
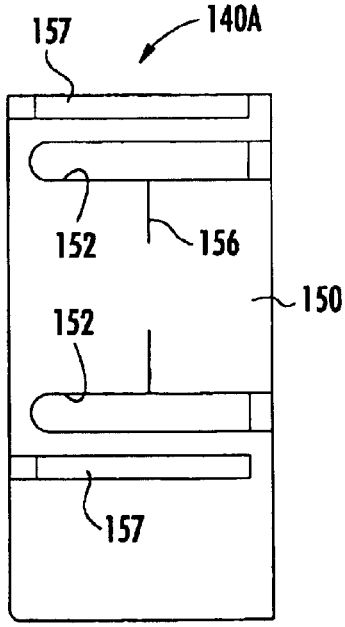
FIG. 11 is a side view of the bracket of FIG. 7.

As best seen in FIGS. 2 and 6, the rail assembly 110 includes a sleeve 112 formed of a suitable polymeric material. The sleeve 112 defines a passage 114 extending from end to end thereof. The sleeve 112 terminates at opposed end edges 116. Preferably, the sleeve 112 is formed of vinyl compound. More preferably, the sleeve 112 is formed of rigid polyvinyl chloride (PVC). The sleeve 112 is preferably formed by extruding; however, any other suitable method, (e.g., molding) may be used.

The rail assembly 110 further includes a reinforcement rail 120. The reinforcement rail 120 has opposed ends 122, a side wall 125, and a top section 126. Other shapes and configurations may be employed for the reinforcement rail 120. The reinforcement rail 120 has exposed portions 124 that extend from the end edges 116 of the sleeve 112 to the ends 122. The portions 124 are "exposed" in that they are not covered or surrounded by the sleeve 112. The portions 124 are preferably fully exposed, but may alternatively be covered, for example, by a separate gasket or spacing element, which preferably is not directly attached to the sleeve 112. The reinforcement rail 120 may be formed of any suitable rigid material. Preferably, the reinforcement rail 120 is formed of metal, polyester, or wood. More preferably, the reinforcement rail 120 is formed of metal or polyester. More preferably, the reinforcement rail 120 is formed of aluminum, steel, or polyester. More preferably, the reinforcement rail 120 is formed of metal, and most preferably of aluminum. The reinforcement rail 120 may be formed by any suitable means, for example, extrusion, stamping or casting.

The brackets 140A and 140B are preferably identical. Accordingly, only the bracket 140A will be described in detail hereinafter, it being appreciated that such description applies equally to the bracket 140B. With reference to FIGS. 7–11, the bracket 140A includes a rear wall 142. A pair of fastener openings 144 and a pair of locator openings 145 are formed in the rear wall 142. The bracket 140A also has a bottom wall 146. A slot 147 is formed in the bottom wall 146 and has a front edge 148. Indicia 149 including pointers and the text "INSERT TO HERE" are positioned adjacent the front edge 148. The bracket 140A includes side walls 150, each having a pair of elongated, horizontally extending slots 152 therein. Inner ribs 154 extend inwardly from the side walls 150 and each have a respective front edge 155. Positioning or scribe marks 156 are provided on the outer surfaces of the side walls 150. Outer ribs 157 extend outwardly from the side walls 150 and each include a respective front edge 158 and a respective rear edge 159. The walls 142, 146, 150 collectively define a rail cavity 160 in the bracket 140A. The cavity 160 opens to the top and the front of the bracket 140A.

The bracket 140A may be formed of any suitable rigid material. Preferably, the bracket 140A is formed of metal or polymer. More preferably, the bracket 140A is formed of metal. Most preferably, the bracket 140A is formed of aluminum or zinc. The bracket 140A may be formed by any suitable method; however, the bracket 140A is preferably formed by casting.

The cover members 170A, 170B are preferably identical. Accordingly, only the cover member 170A will be described hereinbelow, it being understood that such description applies equally to the cover member 170B.

Figure 12:
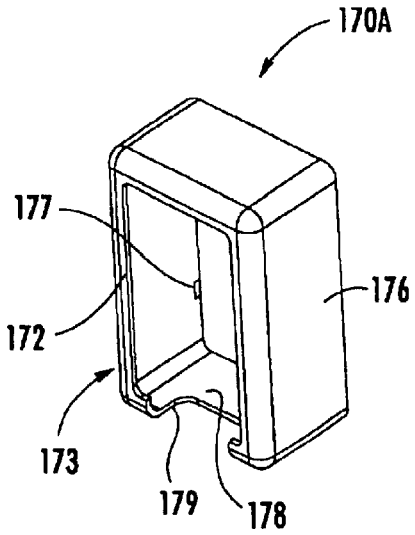
FIG. 12 is a front, perspective view of a cover forming a part of the rail/support system of FIG. 1.
Figure 13:
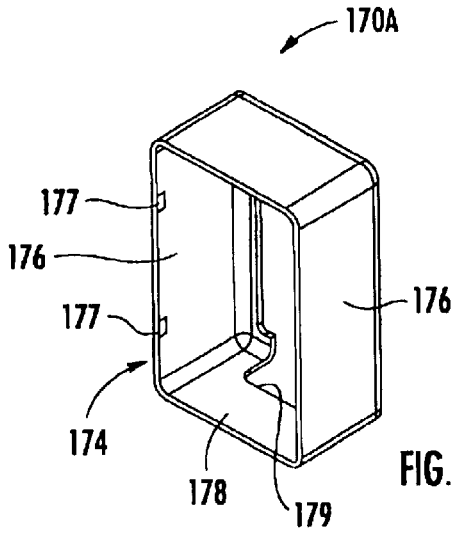
FIG. 13 is a rear, perspective view of the cover of FIG. 12.

With reference to FIGS. 12 and 13, the cover 170A includes a front flange 172 defining a front opening 173. The cover 170A further defines a rear opening 174. The cover 170A has side walls 176. Each of the side walls 176 has a pair of inwardly extending tabs 177 positioned adjacent the rear opening 174. The cover member 170A has a forwardly and downwardly opening cutout 179. Preferably, the cover 170A is formed of a polymeric material. More preferably, the cover 170A is formed of PVC, polyolefin, or ABS The post fasteners 12 and the rail fasteners 14 are preferably screws and, more preferably, self-tapping screws. The fasteners 12 are sized and shaped such that the shanks thereof can pass through the openings 144 and into the posts 7 while the heads of the fasteners are prevented from passing through the openings 144. Similarly, the fasteners 14 should have shanks of proper dimensions to pass through the slots 152 and into the cavity 160 while having heads large enough to prevent the screws 14 from passing fully through the slots 152. It will be appreciated that other types of fasteners (e.g., rivets) may be used as well.

Figure 4:
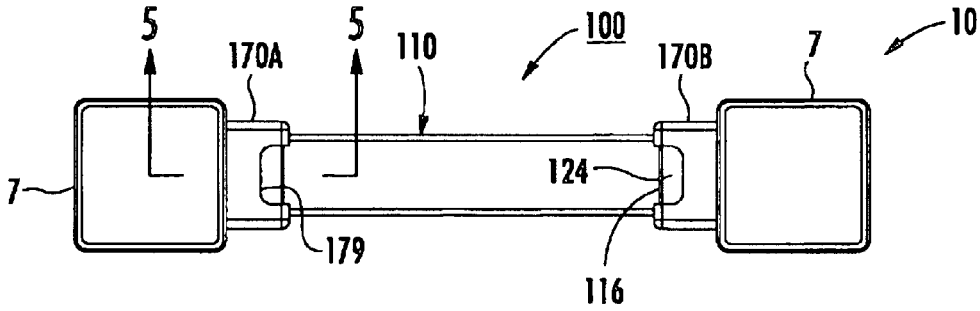
FIG. 4 is a bottom view of the rail/support system of FIG. 1.
Figure 5:
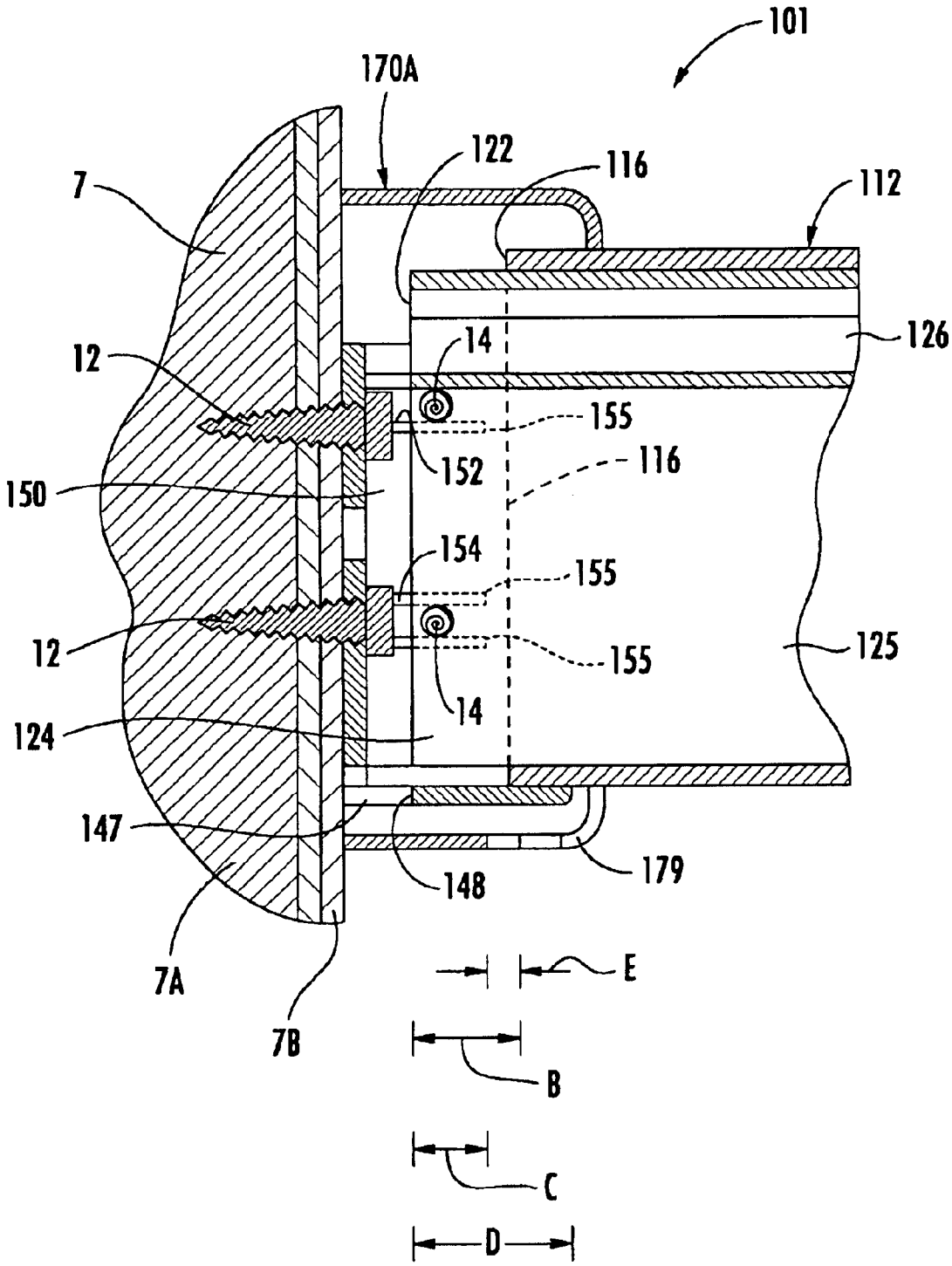
FIG. 5 is a fragmentary, cross-sectional view of the rail/support system of FIG. 1 taken along the line 5—5 of FIG. 4.

As shown in FIGS. 4 and 5, the posts 7 preferably include a rigid wooden post member 7A surrounded by a polymeric cladding 7B. While the posts 7 are described and shown herein, posts of other configurations may be used.

Additionally, other types of vertical supports such as columns and vertically extending walls may be used in place of the posts 7.

The overall assembly of the rail/support system 10 will be better appreciated from the following description of preferred methods for assembling the system 10. However, it will be appreciated that the following assembly method is not the only method by which the system 10 may be constructed.

Typically, the posts 7 will be pre-installed and secured either by attaching to a framework or a structure or embedding in the ground. The bracket 140A is placed at a desired height on the post 7, and the fasteners 12 are inserted through the openings 144 and fastened (e.g., screwed) into the post 7. Similarly, the bracket 140B is mounted on the other post at the desired, corresponding height and the fasteners 12 are inserted through the openings 144 thereof and secured into the post 7.

The user then measures the distance from the edge 148 of the bracket 140A to the edge 148 of the bracket 140B by suitable means. In particular, and with reference to FIG. 8, the user may use a tape measure 30, for example, having a hook 32 on its free end as follows. The user inserts the hook 32 into the slot 147 of the bracket 140A and pulls the hook against the front edge 148. The user then measures the distance to the front edge 148 of the other bracket 140B while the hook 32 is temporarily retained in the slot 147 to conveniently obtain an accurate measurement of the distance from front edge 148 to front edge 148.

In accordance with the direction provided by the indicia 149, the user then cuts the reinforcement rail 120 such that the distance A (FIG. 6) from end 122 to end 122 is equal to the distance between the respective slot front edges 148. Additionally, the user trims the sleeve 112 such that each edge 116 is a prescribed distance from the corresponding adjacent end 122. The length B (FIG. 5) of each exposed portion 124 should be between the distance C (FIG. 5) (i.e., from the slot edge 148 to the rib edge 155) and the distance D (FIG. 5) (from the edge 148 to the front edge of the corresponding side wall 150). In this manner, a margin E (FIG. 5) is provided between the rib end edges 155 and each terminal edge 116 of the polymeric sleeve 112 as shown in FIG. 5. Preferably, the margin E is between about 0.157 and 0.219 inch. Preferably, the length B is between about 0.344 and 0.406 inch less than the distance D.

It is also contemplated that rail assemblies 110 may be provided in various lengths with the exposed portions 124 already being formed at the appropriate lengths. In this case, the user may select the rail assembly 110 of the length corresponding to the measured distance between the respective slot edges 148 rather than having to cut the rail assembly 110 to length and trim the sleeve 112.

The covers 170A, 170B are placed over the rail assemblies 110 and pushed inwardly away from the adjacent ends 122. The cutouts 179 accommodate ballisters, if any are installed in the rail assembly 110. More particularly, the cutouts 179 allow the covers 170A, 170B to be slid inwardly at least far enough to clear the brackets 140A, 140B in the next step.

As best seen in FIG. 5, each end portion of the trimmed rail assembly 118 is placed in a respective one of the cavities 160 of the brackets 140A, 140B, and the rail assembly 110 is positioned such that the ends 122 are aligned with the respective slot edges 148, as instructed by the indicia 149. The rail fasteners 14 are inserted through each of the slots 152 on the same side as the side wall 125, aligned with the scribe marks 156, and driven (e.g., screwed) into the side wall 125 in the exposed portions 124. As the fasteners 14 are tightened, the ribs 154 engage the side wall 125 for a secure and stable coupling.

Notably, as best seen in FIG. 5, the sleeve 112 is not captured between the reinforcement rail 120 and the brackets 140A, 140B. Also, if the preferred additional margins are provided between the end edges 116 and the rib edges 155, room is provided for the sleeve 112 to expand and contract without interference with the brackets 140A, 140B and without causing the edges 116 to move outside of the covers 170A, 170B. This arrangement serves to prevent or inhibit warping or buckling, and otherwise provides for a consistent and attractive appearance.

The covers 170A, 170B are slid toward the adjacent posts 7 and onto the respective brackets 140A, 140B to the positions shown in FIGS. 1–5. The ramped front edges 158 assist the tabs 177 in passing over the ribs 157. The rear edges 159 of the ribs 157 cooperate with the tabs 177 to lock the covers 170A, 170B in place on the respective brackets 140A, 140B. The front openings 173 are sized such that the front flanges 172 closely mate with the outer surface of the sleeve 112 to provide a clean, integrated appearance.

With reference to FIGS. 14–20, an angled rail/support system 20 according to embodiments of the present invention is shown therein. The system 20 includes an angled rail system 200 and posts 7. The system 200 includes an angled rail mounting system 201 and two rail assemblies 210. The system 200 has banisters 16 and upper and lower rail assemblies 210. The rail assemblies 210 correspond to the rail assembly 110, except that the upper rail assembly 210 is further provided with decorative side flanges.

The stair rail mounting system 201 includes brackets 240 corresponding to the brackets 140A, 140B, covers 270 corresponding to the covers 170A, 170B, and fasteners (not shown) corresponding to the fasteners 12 and 14, except that the post fasteners of the angled rail mounting system 201 are longer than the post fasteners 12. Thus, the system 201 corresponds generally to the system 101 except for the further inclusion of angle adapters 280 and 290.

Figure 16:
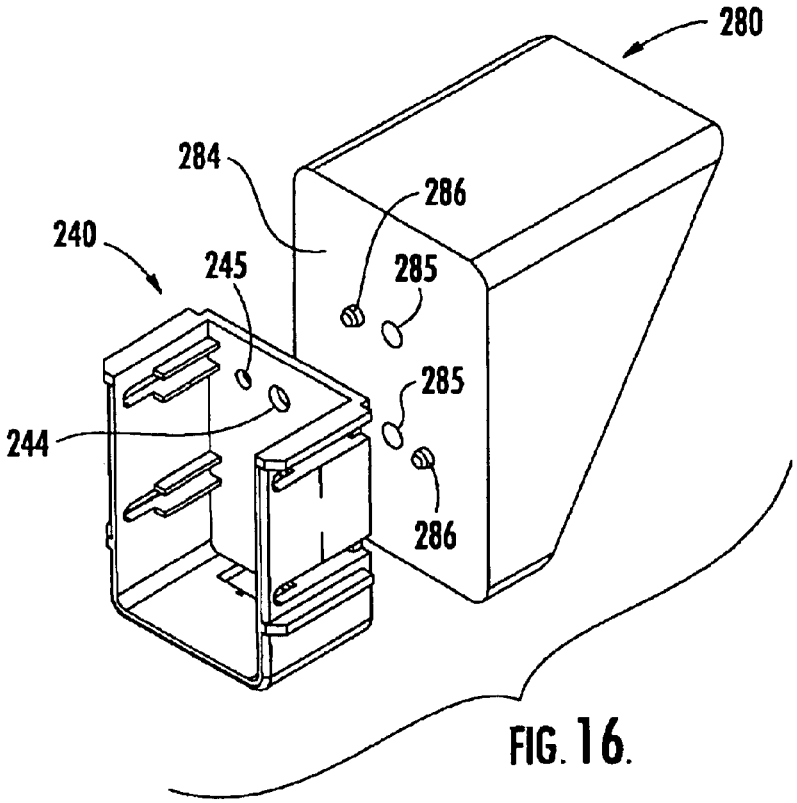
FIG. 16 is an exploded, perspective view of a bracket and an angle adapter forming a part of the angled rail/support system of FIG. 14.
Figure 17:
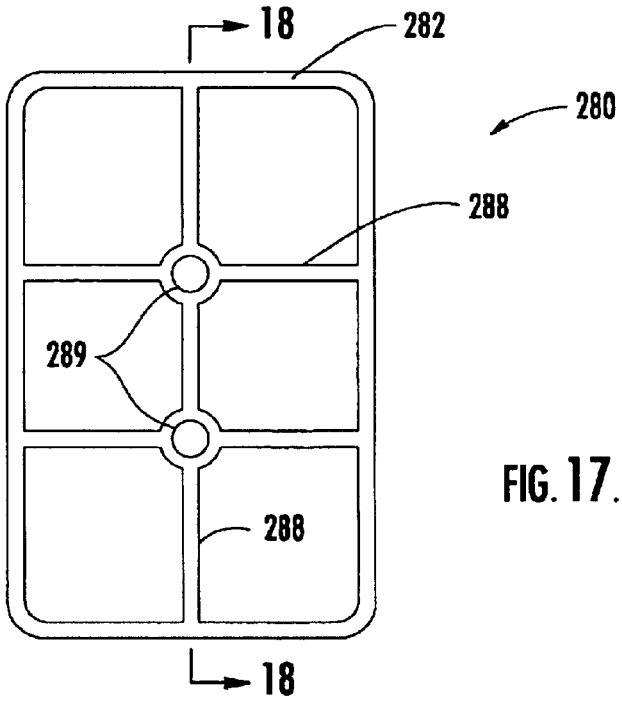
FIG. 17 is a rear view of the angle adapter of FIG. 16.
Figure 18:
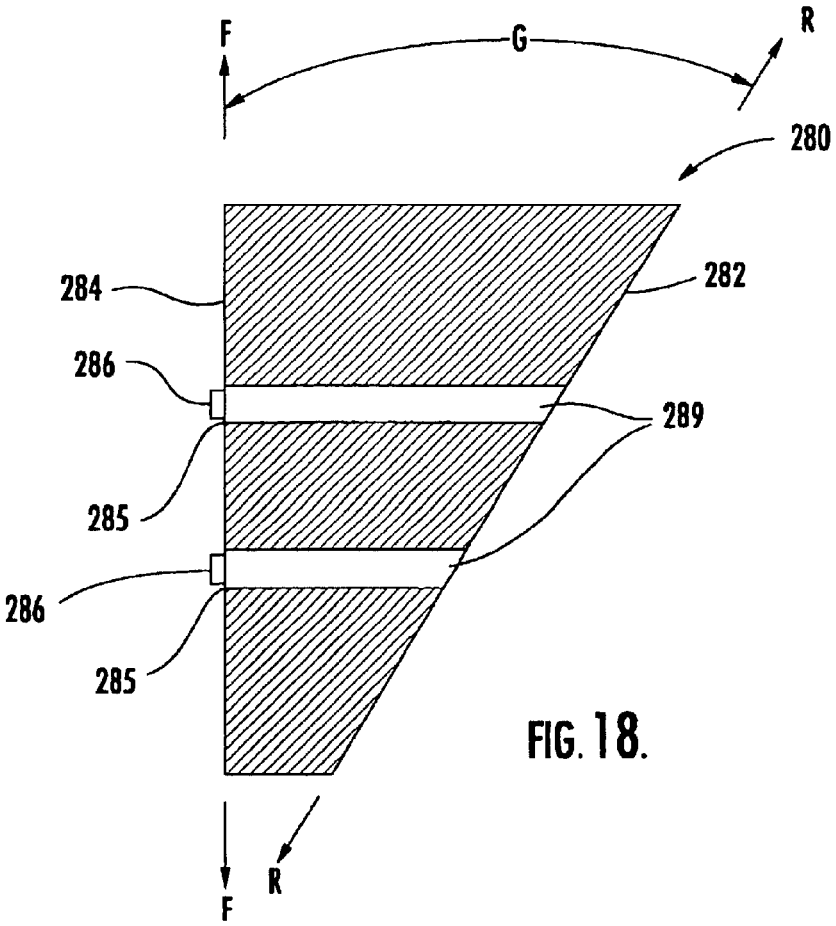
FIG. 18 is a cross-sectional view of the angle adapter of FIG. 16 taken along the line 18—18 of FIG. 17.

With reference to FIGS. 16–18, the lower angle adapter 280 is shown therein. The angle adaptor 280 is preferably formed of a polymeric material, more preferably PVC. This adapter 280 may be injection molded. The angle adapter 280 has a rear face 282 defining an angled plane R—R. The angle adapter 280 further includes a front face 284 having a pair of openings 285 formed therein. A pair of locating pegs 286 extend forwardly from the front face 284. The front face 284 defines a front plane F—F that forms an angle G with the plane R—R of less than 180 degrees. Preferably, the angle G is between about 22 and 42 degrees. More preferably, the angle G is between about 32 and 33 degrees. Most preferably, the angle G is 32.5 degrees. If necessary, the adapter 280 can be cut or trimmed to modify the angle G. A plurality of support walls 288 are located within the angle adapter 280. A pair of fastener passages 289 extend through the angle adapter 280 and terminate at the openings 285.

Figure 19:
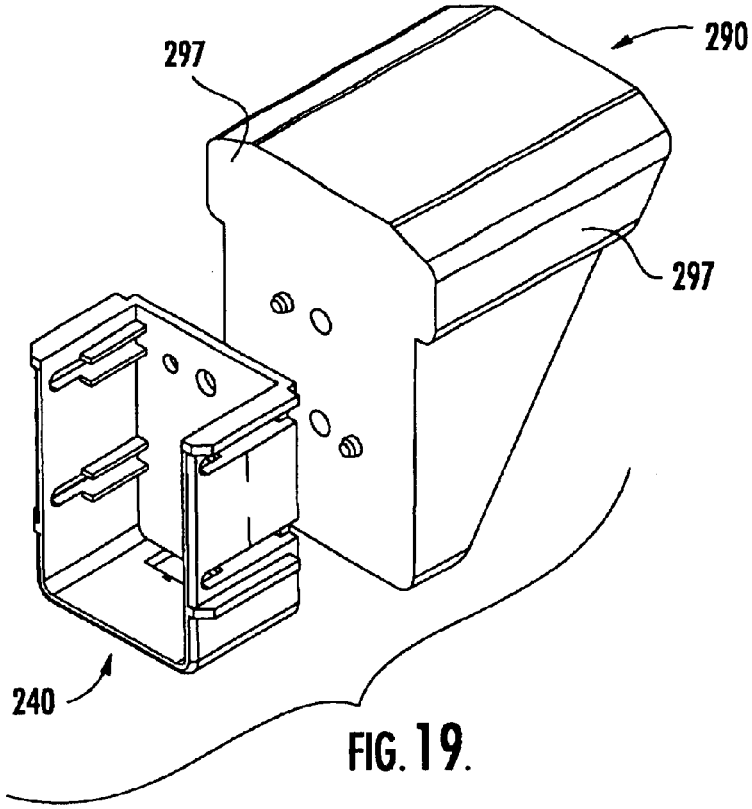
FIG. 19 is an exploded, perspective view of the bracket and a second angle adapter forming a part of the angled rail/support system of FIG. 14.

With reference to FIG. 19, the upper angle adapters 290 are the same as the angle adapters 280 except for the further provision of decorative flanges 297. The decorative flanges 297 are configured to mate with the decorative flanges of the rail assemblies 210.

Figure 14:
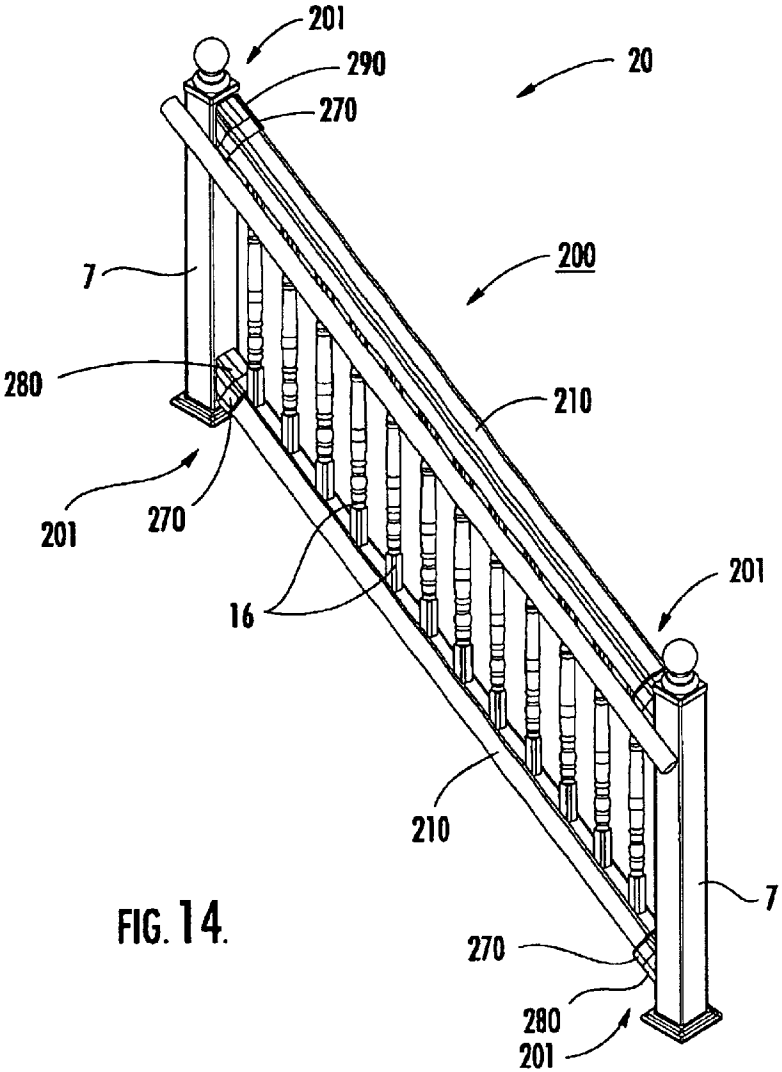
FIG. 14 is a perspective view of an angled rail/support system according to embodiments of the present invention.
Figure 15:
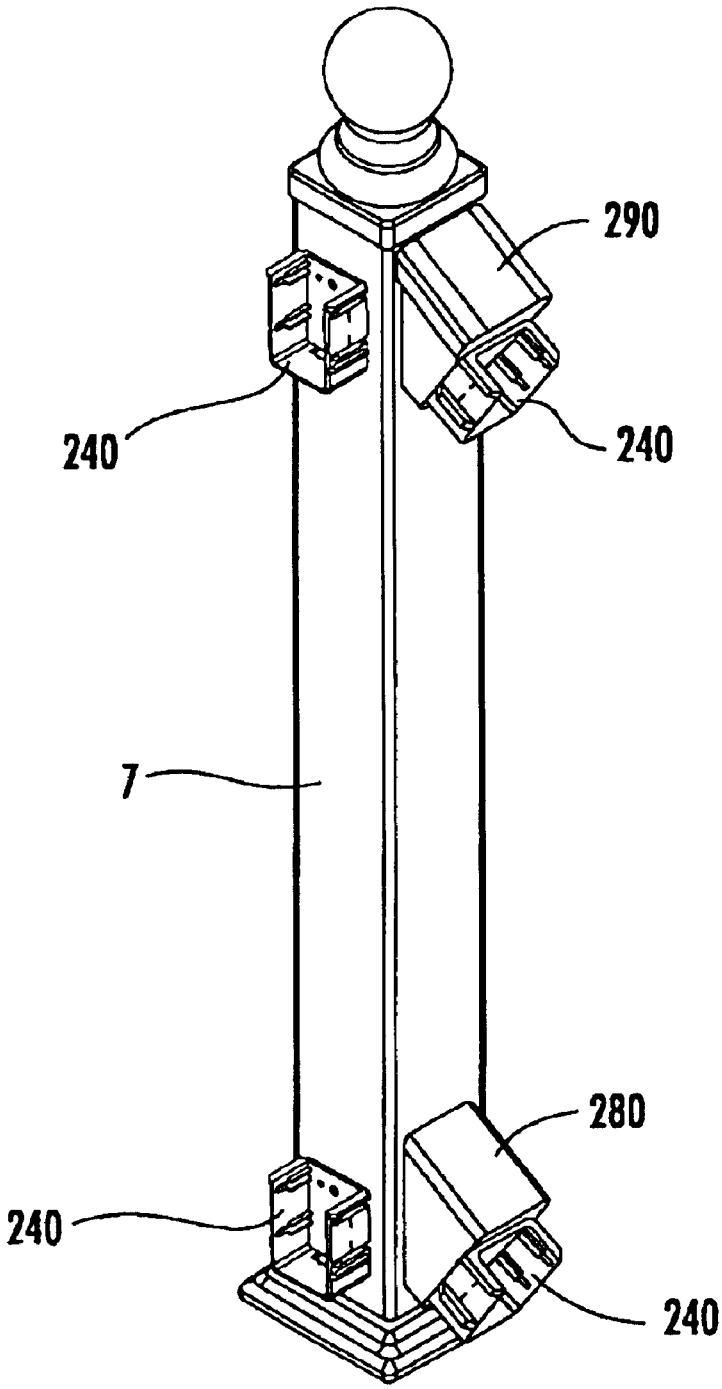
FIG. 15 is a partial view of the angled rail/support system of FIG. 14.

The preferred method of assembling the system 20 is the same as described above for the system 10 except as follows. An angle adapter 280 (or 290) is positioned between the bracket 240 and the post 7 as shown in FIGS. 14 and 15 such that the front face 284 of the adapter 280 or 290 is angled downwardly (for the upper post 7) or upwardly (for the lower post 7). To ensure proper alignment, the bracket 240 is placed on the adapter 280 or 290 such that the locator pegs 286 are inserted through and retained in the locator openings 245 of the bracket 240. The post fasteners 12 are inserted through the openings 244 of the bracket 240 and then through the corresponding and aligned openings 285 and passages 289 such that the fasteners 12 are finally inserted into the post 7, the heads of the fasteners 12 remaining on the front side of the rear wall of the bracket 240.

Figure 20:
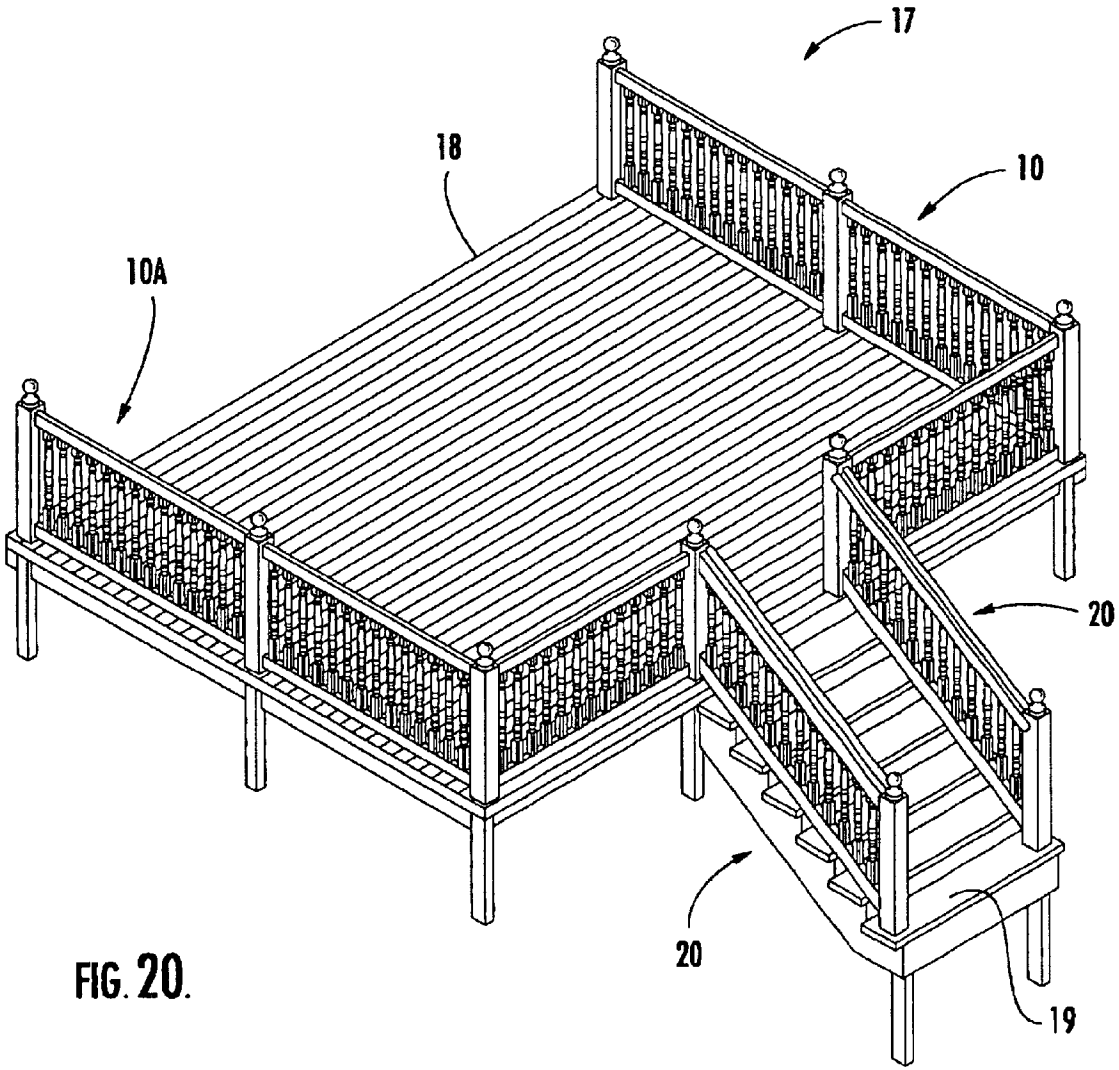
FIG. 20 is a perspective view of a deck incorporating the rail/support system of FIG. 1 and the angled rail/support system of FIG. 14.

FIG. 20 shows an exemplary deck 17 incorporating a rail/support system 10A according to embodiments of the present invention and constructed generally in the manner described above with regard to the system 10. The rail/support system 10A differs from the rail/support system 10 by the further inclusion of a lower rail system and a plurality of banisters extending between the upper and lower rail assemblies. The rail/support system 10A surrounds a platform 18. FIG. 20 also shows a pair of the angled rail/support systems 20 flanking a flight of steps 19.

The rail mounting systems 101, 201, rail/support systems 10, 20, and certain components and subcombinations of components thereof may provide a number of advantages. The brackets 140A, 140B, 240 provide a strong and secure connection between the rail assemblies 110, 210 and the posts 7. The ribs 152 as well as the methods of assembly provide for a stable joinder while nonetheless allowing for expansion and contraction of the polymeric sleeve 112. The covers 170, 270 provide for a clean, integrated appearance. Because the rail assemblies 110, 210 may be fully supported by the brackets 140A, 140B, 240, the materials and configurations of the covers 170, 270 may be selected for aesthetics or other considerations without regard for support strength. Generally, various features of the systems 10, 20 facilitate assembly and versatility of the systems.

The foregoing is illustrative of the present invention and is not to be construed as limiting thereof Although a few exemplary embodiments of this invention have been described, those skilled in the art will readily appreciate that many modifications are possible in the exemplary embodiments without materially departing from the novel teachings and advantages of this invention. Accordingly, all such modifications are intended to be included within the scope of this invention. Therefore, it is to be understood that the foregoing is illustrative of the present invention and is not to be construed as limited to the specific embodiments disclosed, and that modifications to the disclosed embodiments, as well as other embodiments, are intended to be included within the scope of the invention.

That which is claimed is:

1. A rail system for mounting on a vertical support, the system comprising:

a) a rail assembly having an end portion and including:
a reinforcement rail; and
a polymeric sleeve at least partly surrounding the reinforcement rail;

b) a metal bracket defining a rail cavity adapted to receive the end portion and adapted to secure the rail assembly to the vertical support, the bracket including:
a rear wall;
a pair of opposed side walls extending forwardly from the rear wall such that the rear wall extends between the side walls; and
at least one support fastener opening defined in the rear wall between the side walls and in communication with the rail cavity, the at least one support fastener opening being adapted to receive a fastener to secure the bracket to the vertical support; and c) an angle adapter, the angle adapter comprising:
a front face adapted to engage the bracket; and
a rear face adapted to engage the vertical support and forming an angle of less than 180 degrees with the front face;

wherein:
the angle adapter includes a locator projection extending from the front face; and
the bracket defines a locator hole therein adapted to receive the locator projection.

2. The system of claim 1 wherein the polymeric sleeve is formed of a vinyl compound.

3. The system of claim 2 wherein the polymeric sleeve is formed of rigid PVC.

4. The system of claim 1 wherein the bracket includes at least one rail fastener opening in the side walls adapted to receive a fastener to secure the end portion to the bracket.

5. The system of claim 4 wherein the rail fastener opening includes a horizontally extending slot.

6. The system of claim 1 wherein:

a) the reinforcement rail includes an exposed portion extending beyond the polymeric sleeve; and b) the bracket is adapted to bindingly engage the exposed portion such that the polymeric sleeve is not bound by the bracket, whereby the polymeric sleeve is able to expand and contract without interference with the bracket.

7. The system of claim 1 including a cover member at least partly surrounding each of the bracket and the polymeric sleeve.

8. The system of claim 7 wherein the cover member is formed of a polymeric material.

9. The system of claim 8 wherein the cover member is formed of a polymeric material selected from the group consisting of PVC, polyolefin, and ABS.

10. The system of claim 8 wherein the cover member includes means for retaining the cover member on the bracket.

11. The system of claim 1 wherein the bracket includes a slot adapted to receive and temporarily retain a tape measure hook.

12. The system of claim 1 wherein the reinforcement rail is formed of metal.

13. A rail system for mounting on a vertical support, the system comprising:

a) a rail assembly having an end portion and including:
a reinforcement rail; and
a polymeric sleeve at least partly surrounding the reinforcement rail;

b) a bracket defining a rail cavity adapted to receive the end portion and adapted to secure the rail assembly to the vertical support; and c) an angle adapter, the angle adapter comprising:
a front face adapted to engage the bracket; and
a rear face adapted to engage the vertical support and forming an angle of less than 180 degrees with the front face;

wherein:
the angle adapter includes a locator projection extending from the front face; and
the bracket defines a locator hole therein adapted to receive the locator projection.

14. The system of claim 13 wherein the bracket is formed of metal.

15. The system of claim 13 wherein the polymeric sleeve is formed of a vinyl compound.

16. The system of claim 15 wherein the polymeric sleeve is formed of rigid PVC.

17. The system of claim 13 wherein the bracket includes a rear wall and a second wall extending forwardly from the rear wall, the bracket defining:

a) a support fastener opening in the rear wall adapted to receive a fastener to secure the bracket to the vertical support; and b) a rail fastener opening in the second wall adapted to receive a fastener to secure the end portion to the bracket.

18. The system of claim 17 wherein the rail fastener opening includes a horizontally extending slot.

19. The system of claim 13 wherein:

a) the reinforcement rail includes an exposed portion extending beyond the polymeric sleeve; and b) the bracket is adapted to bindingly engage the exposed portion such that the polymeric sleeve is not bound by the bracket, whereby the polymeric sleeve is able to expand and contract without interference with the bracket.

20. The system of claim 19 wherein the sleeve has an end edge and, when the end portion is disposed in the rail cavity, the end edge of the sleeve is disposed in the rail cavity.

21. The system of claim 19 wherein the bracket includes a rib extending inwardly into the rail cavity and adapted to bindingly engage the exposed portion.

22. The system of claim 21 wherein the rib has a front edge and the sleeve has an end edge and, when the end portion is disposed in the rail cavity, the end edge of the sleeve is disposed in the rail cavity and forwardly of the front edge of the rib.

23. The system of claim 13 including a cover member at least partly surrounding each of the bracket and the polymeric sleeve.

24. The system of claim 23 wherein the cover member is formed of a polymeric material.

25. The system of claim 24 wherein the cover member is formed of a polymeric material selected from the group consisting of PVC, polyolefin, and ABS.

26. The system of claim 24 wherein the cover member includes means for retaining the cover member on the bracket.

27. The system of claim 13 wherein the bracket includes a slot adapted to receive and temporarily retain a tape measure hook.

28. The system of claim 13 wherein the reinforcement rail is formed of mental.

29. The system of claim 13 wherein the bracket is rigid.

30. The system of claim 13 wherein the bracket includes:

a rear wall;

a pair of opposed side walls extending forwardly from the rear wall such that the rear wall extends between the side walls; and at least one support fastener opening defined in the rear wall between the side walls and in communication with the rail cavity, the at least one support fastener opening being adapted to receive a fastener to secure the bracket to the vertical support; and at least one rail fastener opening in the side walls adapted to receive a fastener to secure the end portion to the bracket.

31. The system of claim 30 wherein the rail fastener opening includes a horizontally extending slot.

* * * * *